United States Patent [19]

Vermot-Gaud et al.

[11] Patent Number: 4,732,498

[45] Date of Patent: Mar. 22, 1988

[54] NEEDLE MATRIX PRINTER

[75] Inventors: Jacques Vermot-Gaud, Perly; Didier Joyeux, Petit-Lancy, both of Switzerland

[73] Assignee: Battelle Memorial Institute, Geneva, Switzerland

[21] Appl. No.: 905,386

[22] PCT Filed: Dec. 16, 1985

[86] PCT No.: PCT/CH85/00176

§ 371 Date: Aug. 19, 1986

§ 102(e) Date: Aug. 19, 1986

[87] PCT Pub. No.: WO86/03718

PCT Pub. Date: Jul. 3, 1986

[30] Foreign Application Priority Data

Dec. 19, 1984 [CH] Switzerland ..... 6023/84

[51] Int. Cl.[4] ..... B41J 3/12

[52] U.S. Cl. ..... 400/124; 101/93.05

[58] Field of Search ..... 400/118, 119, 121, 124; 101/93.04, 93.05; 335/219, 223

[56] References Cited

U.S. PATENT DOCUMENTS

| | | | |
|---|---|---|---|
| 3,754,199 | 8/1973 | Lisinski | 400/124 X |
| 4,493,568 | 1/1985 | Estabrooks | 400/124 |

FOREIGN PATENT DOCUMENTS

| | | | |
|---|---|---|---|
| 2733312 | 3/1978 | Fed. Rep. of Germany | 400/157.2 |
| 2234755 | 1/1975 | France | 400/121 |
| 58-145467 | 8/1983 | Japan | 400/124 |
| 1423518 | 2/1976 | United Kingdom | 400/121 |
| 867682 | 9/1981 | U.S.S.R. | 400/121 |

*Primary Examiner*—Paul T. Sewell

*Attorney, Agent, or Firm*—Cushman, Darby & Cushman

[57] ABSTRACT

The printer comprises a series of needles (1) each associated to an electric lead (8) which extends in the gap of a permanent magnet (11). The extremities of each lead are fixed to respective supports (9,10) and are selectively connected to a current source to make a current (I) circulate in said leads so that, in the presence of a magnetic field in the air gap, a force (F) acts upon the lead (8) which communicates to the needle (I) an elongation (e) in the direction of the surface to be printed.

7 Claims, 5 Drawing Figures

NEEDLE MATRIX PRINTER

This invention relates to a needle matrix printer comprising a set of needles each of which is mounted to be longitudinally slidable and is associated with an electrical lead which is flexible over at least part of its length and is situated in a plane containing said needle, a part of which is in engagement with the central part of said lead, at least one segment of the said lead being situated in the air-gap of a permanent magnet having a homogeneous magnetic field perpendicular to said plane, a lateral force being exerted on said lead when a current passes through it.

G.B.-A-1,423,518 already proposes actuating an electrodynamic matrix printer needle, for which purpose a loop is formed along a needle portion spaced laterally from its guidance axis. Current pulses are passed through said needle, said loop being disposed opposite the end of a magnetic bar which produces a magnetic field diverging in the direction of the needle loop. When a current pulse passes through said loop, it tends to embrace the maximum magnetic flux leaving the magnetic bar so that the loop is attracted towards the end of the bar.

A solution of this kind has considerable disadvantages. More particularly, it does not allow a plurality of needles to be stacked, because of the presence of the loops, so that a matrix printer comprising a plurality of needles is practically impossible to construct. Also, this solution actuates the needle by pushing it from its centre. Since, on the one hand, said needle must be capable of undergoing deformation easily to allow the movement of its free end towards the printing surface and, on the other hand, it must be sufficiently rigid to withstand compression, two contradictory requirements have to be satisfied simultaneously. It must also be noted that this type of actuation moves the needle at a speed which tends towards zero and a compression force which increases so that the kinetic energy in turn tends towards zero. This type of actuation is therefore unsuitable for a printing method in which the ink is transferred following an impact, from its support to the sheet for printing.

JP-A-58 145 467 describes a printer in which each needle is mounted slidably and its rear end bears against a segment of an electrical lead immersed in a homogeneous magnetic field. One end of said lead is fixed while its other is mounted to be longitudinally slidable so that when a current passes through said lead a lateral force is exerted thereon. This force produces lateral deformation of this lead by longitudinal sliding of its end. This laterally deformed lead part acts on the rear end of the needle and thus moves it longitudinally.

This solution has one important disadvantage. Since the needle is axially thrust by the laterally deflected lead portion, the force exerted on said needle is limited by the inherent flexibility of said lead. As soon as the needle meets any resistance in its movement, the lead deflects in the opposite direction so that the striking force and/or compression force of the needle can be only low and in any case does not exceed the force required to deflect the lead, which must obviously be as low as possible. This solution therefore combines two contradictory conditions.

Another electrodynamic solution is described in U.S. Pat. No. 3,918,567, which proposes a stack of hammers formed by plates having elastic tongues formed by cut-outs and intended to allow transverse movement of said plates, which are immersed in a magnetic field perpendicular to their planes, when a current is fed longitudinally along said plates.

Practical problems which are very difficult to solve arise in embodying such a solution. Each plate has a length equivalent to the width of the printing surface. This means a very long magnet and sufficient rigidity of the plates, hence a width and thickness proportional to said length, and hence a high mass, which necessitates a considerable current to actuate the plate at high speed. The example given indicates 40 watts so that it is easy to calculate that each plate must be fed with a 70A current. This causes problems since a current of this kind must be created in 1 millisecond and the strip must be fed with this high current. The reason for this is that since the current has to pass through the elastic suspension elements where the passage section is reduced by the cut-outs, the elastic tongues are likely to be damaged by excessive heating. With this design, in which the elasticity is provided by tongues cut out from a plate, these tongues are very short and are subject to considerable fatigue. If their thickness is reduced in order to reduce this fatigue, then the overheating due to the passage of the current increases further. These relatively short tongues allow only a proportionally limited travel of the striking elements, such travel being less than 0.25 mm. Also, this travel and the speed of movement are also limited by the maximum current which can be achieved. In the example described, the acceleration is only 2400 m/sec$^2$ so that without allowing for the appreciable absorption of force by the elastic suspension tongues, this gives a movement time of 1.5 milliseconds for an 0.25 mm travel. The stack of plates between the magnet poles creates a large air-gap proportional to the number of plates. Finally, the block or anvil against which the plates strike is not of very great rigidity, thus reducing the rebound effect, which reduces the recoverable kinetic energy. It is therefore seen that this solution has numerous disadvantages and undoubtedly does not meet the conditions that dot matrix printers are required to satisfy.

Another electrodynamic solution is proposed in SU-A-867 682, in which document the striking elements are formed by plates secured to leads in strip form, the plates extending in respective planes perpendicular to those of the conductive strips. These strips are fixed at their respective ends and have two slight curves to give them some elasticity in the direction of their deformation. This solution has a number of disadvantages. The plates used to rigidify the central part of the conductive strips are heavy. The slight curves intended to give the strips elasticity create excessive metal fatigue, the air-gap is proportional to the width of the strips and to the number thereof. A solution of this kind cannot satisfy the requirements to which dot matrix printers are subject.

The object of this invention is precisely to remedy the disadvantages of the above solutions at least partially. To this end, this invention relates to a needle matrix printer according to claim 1.

The solution proposed by this invention offers several advantages. The electrodynamic actuation is disassociated from the needle so that it is possible to use a rigid needle and an electrical lead of flexible actuation. The flexible conductor works solely under tension. The needle receives a kinetic energy capable of creating a pulse of sufficient force to provide good ink transfer from the inking support to the surface for printing. The magnet air-gap may be of the same order of magnitude as the transverse dimension of the lead perpendicular to the plane of said air-gap. There is no problem in stacking a plurality of needles, this being particularly advantageous in the case of a matrix printer, and it can be done without the air-gap being proportional to the number of needles stacked.

This solution enables a considerable travel to be transmitted to the needles, of the order of a millimeter, with accelerations of the order of 6000 $m/s^2$ which is very much better than the existing solutions. The masses involved are also very low. The current passage cross-section is constant so that there are no lead heating points. The lead elasticity is good and can be limited to certain parts of the lead without increasing either the mass or the current passage section. The non-flexible parts may be made from aluminium, which increases the electromechanical conversion efficiency.

The accompanying drawings illustrate by way of example one embodiment and variants of the needle matrix printer according to this invention.

Figure 1:
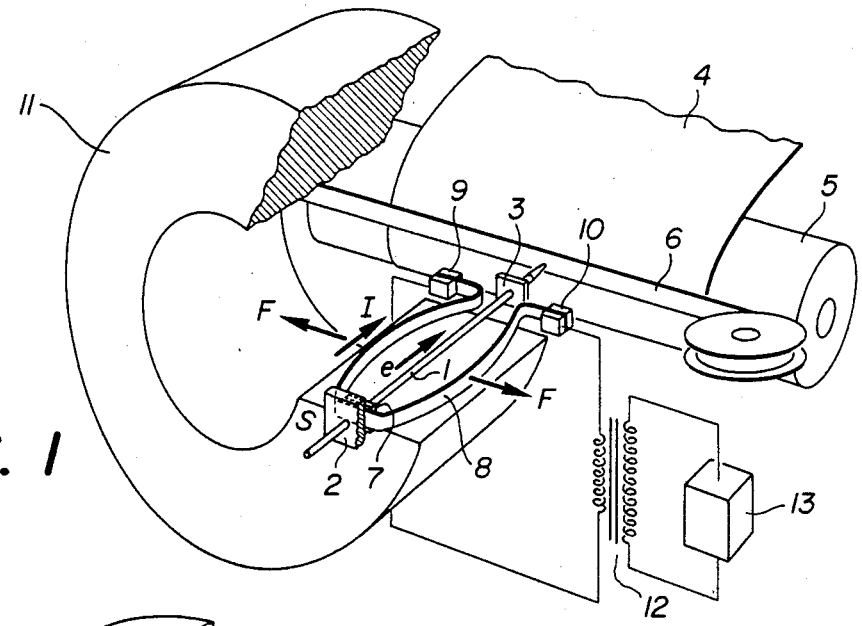
FIG. 1 is a perspective view of one embodiment.

FIG. 1 illustrates an embodiment in which only one needle 1 is illustrated in order to simplify the drawing. Obviously, however, a plurality of needles may be disposed in a stack. The description here with respect to one needle by way of example obviously applies to each needle of a needle type matrix printer.

The needle 1 is guided by two bearings 2 and 3 in a direction perpendicular to a sheet 4 for printing disposed on a supporting roller 5, an inking ribbon 6 being moved between the front tip of the needle 1 and the sheet 4 for printing in known manner. The said needle 1 is connected, by a stop 7 integral therewith, to an electrical lead 8 which, in this example, is formed by a thin flexible copper strip bent into hairpin shape and fixed at its two ends to two supporting elements 9 and 10 which, like the bearings 2 and 3 of the needle 1, are integral with, for example, a carriage (not shown) which is movable along an axis parallel to that of the roller 5. Said carriage is adapted to carry a permanent magnet 11 in whose air-gap the electrical lead 8 is situated. The ends of this lead are connected to the secondary winding of a transformer 12, the primary of which is connected to a current pulse source 13.

When a current pulse I passes through the lead 8, forces F are exerted on the lead 8. Since the ends of this lead are fixed to the support elements 9 and 10, these forces result in an expansion of the hairpin formed by the lead 8 so that the bent portion of the hairpin approaches the support elements 9 and 10 and drives the needle 1 forwards.

Tests have been carried out with a needle structure of this kind using an electrical lead 8 formed from a CuAg strip of a thickness of 50 μm and a width of 0.7 mm. The length between the anchoring points 9 and 10 and the hairpin loop is 3 cm, the actual needle 1 is made from a tungsten wire 0.35 mm in diameter. The maximum spacing between the two strands of the lead 8 is of the order of 3 mm. The elongation e of the needle 1 subsequent to the application of a current of 1 A in the lead 8 with a magnetic field of 0.5 Tesla is from 100 to 200 μm. This was in the case of static conditions, which do not correspond to reality, since the needle is actuated in accordance with a dynamic principle by brief current pulses. In this case, with pulses of 5 A for 0.5 ms elongations e of the needle 1 from 200 to 400 μm were measured.

In view of the method of operation, in which the strip forming the lead 8 works under tension and can be as flexible as possible, the fatigue of the lead is very slight. On the other hand, the needle 1, which must be relatively rigid, undergoes no fatigue. The elongations produced under dynamic conditions are considerable without the deformation of the lead 8 subjecting it to any excessive fatigue. To obtain a good elongation of the needle 1 it is preferable for the strands of the lead 8 in the inoperative state to be slightly curved outwardly as shown in FIG. 1, in which position a movement of the strands away from one another results in a greater elongation of the needle than from parallel and rectilinear strands.

Figure 2:
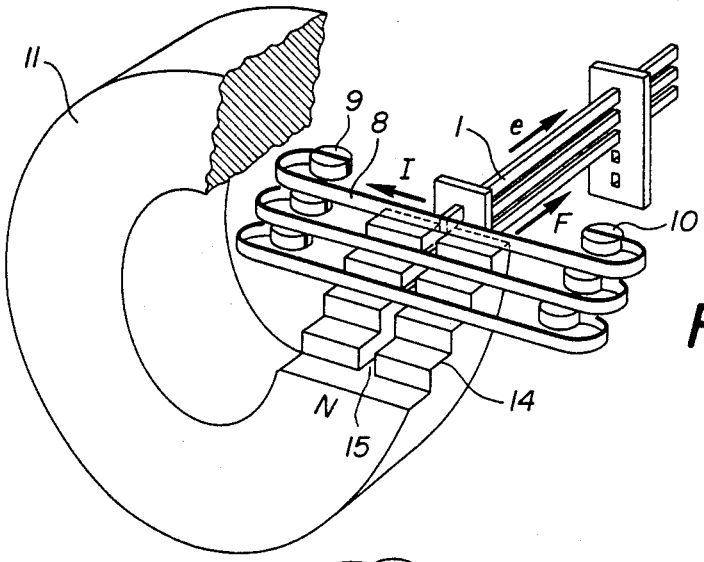
FIG. 2 is a perspective view of a variant of FIG. 1.

Another configuration to increase the needle elongation still further is also possible. This configuration is shown by the variant of FIG. 2. It consists essentially in moving the anchoring points 9 and 10 of the lead 8 apart so that the deformation produced by the electromagnetic forces applied to the leads 8 on passage of a current I result in an elongation of the respective needles equal to the deflection of the lead subjected to forces F.

It will be seen that FIG. 2 shows substantially the same elements as those in FIG. 1, elements having like functions being denoted by like references.

This configuration has several advantages over the embodiment shown in FIG. 1. It will be immediately apparent that the elongation e of the needle 1 corresponds to the lateral deformation of the lead 8 subject to the electromagnetic deflection force F. The elongation e is therefore maximum in the case of this configuration.

To obtain a print with a maximum of contrast, the needle must be given the maximum possible kinetic energy from a force F applied for a time t. Since this kinetic energy W is:

$$W = F \times e$$

where e is the elongation of the needle 1 for the time t, it will be seen that it is advantageous for e to be as high as possible during this time t. This elongation e will increase with reducing mass m of the needle 1 given a force F and a time t, i.e. a given frequency $$e = \frac{1}{2}\frac{F}{m}t^2$$

while the kinetic energy $$W = \frac{1}{2}\frac{F^2}{m}t^2.$$

The configuration of FIG. 2 is therefore the optimum from this aspect since the entire amplitude of the deformation of the lead 8 is transmitted to the needle 1. Also, this lead 8 operates under tension like the one in FIG. 1.

The construction shown in FIG. 2 has other advantages. Since only a rectilinear portion of the leads 8 is situated in the air-gap of the permanent magnet 11, the width of the air-gap need correspond only to a little more than the amplitude of the lateral deflection of the lead 8. Consequently, using the configuration shown in FIG. 2, each N and S pole of the permanent magnet 11 may be step-shaped as at 14, a slot 15 allowing the passage of the needles 1. The matching configuration of the S pole (not shown) of the magnet 11 allows the minimum air-gap to be provided, corresponding substantially to the width of the section of each lead 8, thus providing high magnetic induction. This configuration with the leads 8 parallel to the printing surface gives a compact needle matrix printer head.

It should, however, be mentioned that the efficiency of the electrodynamic force applied to the lead 8 is halved because of the triangulation effect resulting from the lateral deformation of the lead 8, so that the force F acting on the needle 1 corresponds to:

$$F=0.5\,f\times l$$

where f denotes the elementary forces exerted along the conductor 8 over the entire length 1 of the air-gap where f=BI, B being the magnetic induction and I the current.

Figure 3:
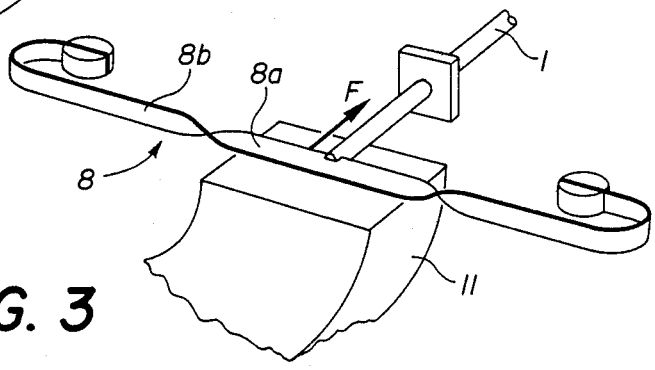
FIG. 3 is a perspective view of another variant.

The variant shown in FIG. 3, which is directly applicable to the needle matrix printer head shown in FIG. 2, obviates this triangulation effect by making that portion 8*a* of the lead 8 which is disposed in the air-gap of the permanent magnet 11 more rigid. It has been found that with a strip-shaped lead 8 the rigidity of the portion 8*a* can be produced simply by twisting the strip through 90° about its longitudinal axis so that its width is in the plane of application of the force F. Consequently, the portions 8*b* of the lead provide the elastic suspension for the portion 8*a* which does not undergo deformation and enables the triangulation effect resulting from a completely flexible lead to be eliminated.

Because of the rigidity of this portion 8*a*, $F=l\times f_1$, so that the kinetic energy can be greatly increased since $$W=\tfrac{1}{2}\frac{F^2}{m}t^2$$

where the value F is the numerator of the fraction and is squared.

In addition, the air-gap of the magnet 11 can be further reduced.

By way of example and as a guide, a motive force F of 0.32N is obtained with a lead 8 having a part 8*a* 4 cm in length, a magnetic induction of 0.8 Tesla, and a current I of 10 A applied for 0.5 ms.

If the mass of the needle 1 is $50.10^{-6}$ kg, the resulting kinetic energy is $0.25.10^{-3}$ J, which is ample to provide good printing contrast.

In the case of the variant shown in FIG. 2, the portion of the lead 8 situated in the air-gap of the magnet 11 could be made more rigid by increasing the thickness of said portion, e.g. by welding a segment of the same strip against this portion of the lead.

Static supply experiments on a lead 8 of the type illustrated in FIG. 2 were carried out to measure the needle elongation. The lead was made from an AgMgO wire of 0.25 mm diameter with a 4 cm straight portion, the needle 1 being made from a tungsten wire 0.35 mm in diameter and 35 mm long and having a mass of 68 mg. The elongations measured were 0.06 mm in the case of 0.2 A; 0.12 in the case of 0.4 A; 0.17 in the case of 0.6 A; 0.22 in the case of 0.8 A; and 0.28 in the case of 1 A.

Similar tests carried out with the construction illustrated in FIG. 3 using a lead 8 made from a CuAg strip of a section of 0.05×1 mm, of which the portion 8*a* had a length 1 of 4 cm and a length between the bent portions 8*b* of 7.1 cm, and an AgMgO needle of a diameter of 0.25 mm and a length of 25 mm, with a mass of 12.5 mg, gave the following elongations, again under static conditions: 0.43 mm with a current of 0.2 A; 0.884 mm with 0.4 A; 1.284 mm with 0.6 A; 1.720 mm with 0.8 A and 2.030 mm with 1.0 A. Between the embodiments shown in FIGS. 2 and 3, and with a lightweight needle, the elongation for the same current was found to be practically one order of magnitude greater in the case of FIG. 3.

Under dynamic conditions at a frequency above 100–200 Hz it was found that the needle return no longer has time to take place, thus limiting the useful elongation and also the frequency. Tests to obtain positive control of the needle return were therefore carried out by reversing the direction of the current I in the lead 8.

The tests were carried out with a mechanism similar to that shown in FIG. 3 using a needle identical to that used previously, i.e. a needle cut from an AgMgO wire 0.25 mm in diameter and 25 mm long having a mass of 12.5 mg. The lead 8 was made from a CuAg strip 50 μm thick and 1.5 mm wide, having a mass of about 0.60 mg/mm. The total length of the wire between the supports 9 and 10 was 75 mm. The length of the portion 8*a* situated between the magnet air-gap was 50 mm. The conductor mass was therefore 0.60×75=45 mg and the total mass, needle plus lead, was therefore 45+12.5=60 mg. The resistance R of the lead 8 is about 40 mΩ. The magnetic induction B in the magnet air-gap was about 0.75 Tesla. An alternately positive and negative pulse train of 0.4 volt of 500 μs was applied to the lead 8. The current I was therefore:

$$I=\pm\frac{0.4}{40.10^3}=10A$$

The dissipated power in the useful part about 60 mm in length was 2 watts.

The electrodynamic force produced was:

$$B.1.I=0.75.50.10^{-3}.10=0.375N$$

The acceleration was $$\frac{F}{m}=\frac{0.375}{60.10^{-6}}=6250\ \mathrm{m/s^2}$$

In this connection it was found that this acceleration is practically three times greater than that obtained in U.S. Pat. No. 3,918,567 referred to hereinbefore, and this is considerable.

The velocity attained at the end of the 500 μs pulse was:

$$V=\frac{F}{m}\cdot t=6250\cdot 500\cdot 10^{-6}=3\ \mathrm{m/s}$$

The corresponding energy was:

$$W=\tfrac{1}{2}\frac{F^2}{m}\cdot t^2=0.27\ \mathrm{mJ}$$

Tests have shown that the positive pulse I accelerates the mass to about 2.5 m/s at the time of impact against the surface for printing, which is about 0.7 mm away from the needle tip in the inoperative position. The negative pulse decelerates the needle and is added to the needle rebound from the paper and its support to return the needle rearwardly. In view of these two effects which cause the needle return, the needle can still be accelerated by staggering the negative pulse with respect to the rebound subsequent to the impact against the surface for printing and thus reducing the duration of this negative pulse. For example, this pulse can be staggered by 0.2 ms and be reduced to 0.3 ms so that the needle does not recede beyond the inoperative position.

With 5 A pulses for a time corresponding to:

$$0.5 \text{ ms} = \sqrt{2} = 0.7 \text{ ms}$$

it was found that the same speed and same kinetic energy were obtained, but the dissipated power is then one-fourth, i.e. 0.5 watts. However, the frequency is reduced by 40%.

As described in connection with FIG. 1, the lead 8 is preferably fed by means of a transformer 12. The primary of this transformer, which is connected to the pulse source 13, may, for example, have 50 turns and the secondary connected to the lead 8 may have two turns. In that case, a voltage of 10 V on the primary and a current of 0.4 A gives a voltage of 0.4 V and a current of 10 A at the secondary.

Of course the lead can also be fed without a transformer, using power transistors, preferably field-effect transistors having low voltage and resistance in the conductive state.

Figure 4:
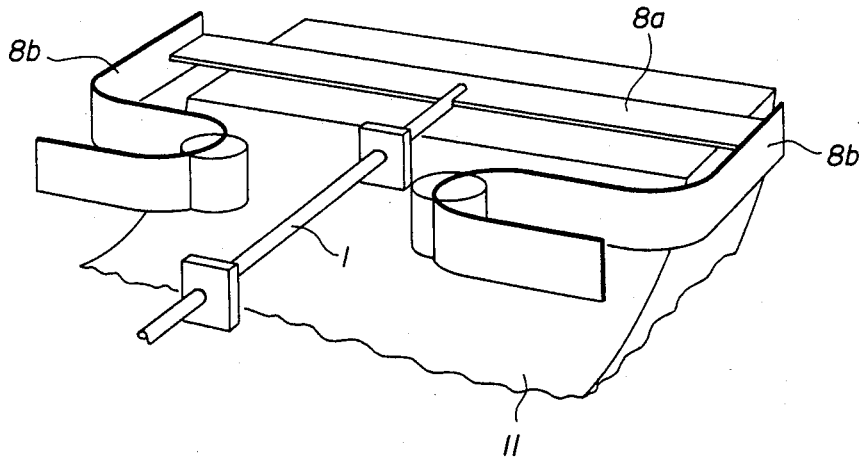
FIG. 4 is a perspective view of yet another variant.

The solution shown in FIG. 4 is a variant of that in FIG. 3, in which the more rigid segment 8*a* is formed by a strip of aluminium welded at its respective ends to the bent portions 8*b* which are made of a CuAg alloy strip or wire. With this solution the fact that a strip of aluminium is used in the magnet air-gap enables the efficiency of electromechanical conversion to be improved, for this efficiency which is given by the formula:

$$\eta = 0.5 \frac{B_0^2 T}{\rho d}$$

where B=magnetic induction
T=pulse time
$\rho$=resistivity
d=density
in the case of copper $\rho d \sim 1.8.10^{-4}$ while in the case of aluminium $\rho d \sim 0.73.10^{-4}$.

Figure 5:
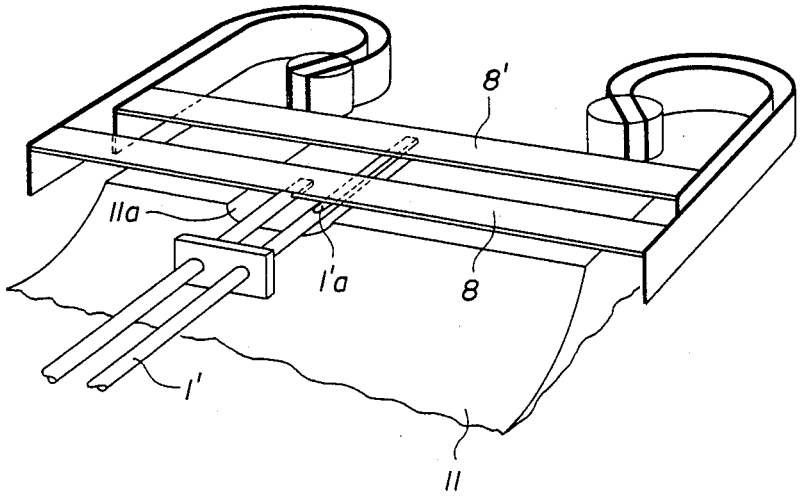
FIG. 5 is a perspective view of a variant of FIG. 3.

FIG. 5 shows another variant of FIG. 3 in which two leads 8 and 8' are disposed in parallel in the same plane and hence in the same air-gap of the magnet 11. In this variant the two leads are in the air-gap plane so that the occupied air-gap can be reduced to the strict minimum corresponding to the thickness of just the conductors 8 and 8'. For this purpose, a transverse groove 11*a* is formed in one pole face of the magnet 11 to allow the passage of the needles 1 and 1'. That part of the needle 1' which passes beneath the lead 8 and which is welded beneath the lead 8' has a flat 1'*a* to reduce its thickness.

As the various embodiments described show, the needle matrix printer according to this invention enables a compact printing head to be produced of simple construction and giving a print of good contrast.

It should also be noted that the type of electrodynamic actuator (a conductive element immersed in a magnetic induction) is particularly suitable for controlling the impact force of the printing needle because the motive force is algebraically proportional to the current. The impact force can therefore be reduced, for example by using a negative current pulse following the positive pulse. This will enable the noise source level to be greatly reduced. However, since the printing force is reduced it is advantageous to compensate for this reduction by an additional energy supply since it is, for example, possible to replace the support roller 5 of FIG. 1 by a block in the form of an ultrasonic transducer.

What is claimed is:

1. A needle matrix printer comprising a set of needles each of which is mounted to be longitudinally slidable and is associated with an electrical lead which is flexible over at least part of its length and is situated in a plane containing said needle, a part of which is in engagement with the central part of said lead, at least one segment of the said lead being situated in the air-gap of a permanent magnet having a homogeneous magnetic field perpendicular to said plane, a lateral force being exerted on said lead when a current passes through it, characterised in that the two ends of said lead are fixed to two respective anchoring elements, said lead forming an elongate open loop between said elements, which is positioned on opposite sides of the needle and in a common plane therewith so that the needle is free to move along its longitudinal axis, said loop including a longitudinal strand to form the said segment situated in said air-gap, and means for exerting the said lateral force on the longitudinal strand to deform said loop and thereby move said central part along the longitudinal axis of said needle so as to move said needle.

2. A printer according to claim 1, characterised in that the said lead is of rectangular section, the major axis of said section being oriented perpendicularly to the plane of the force produced following the passage of the current through said lead.

3. A printer according to claim 1, characterised in that the longitudinal strand of the elongate loop is open on one side and situated in said air-gap, said strand being less flexible in the plane of the force induced by the passage of the current than the rest of the loop situated outside the said air-gap.

4. A printer according to claim 2 or 3, characterised in that that portion of the longitudinal strand of said lead which is situated in said air-gap has the major axis of its section in the plane of said force whereas the portions situated outside said air-gap have the major axis of said section perpendicular to the plane of said force.

5. A printer according to claim 1, characterised in that the two poles of the said permanent magnet are shaped as parallel staircases spaced apart by the value of said air-gap, each step of said staircase-shaped air-gap having extending through it longitudinally the longitudinal strand of the elongate loop open on one side and associated with one of the needles of the printer, the width of each step of the said staircase-shaped air-gap corresponding substantially to the amplitude of the movement of said strand in response to said force.

6. A printer according to claim 1, characterised in that that portion of the said longitudinal strand of the elongate loop open on one side which is situated in said air-gap is made of aluminium, the remainder of said lead being made of copper.

7. A printer according to claim 1, characterised in that two needles are disposed side by side with respect to the parallel planes of the poles of said air-gap, each being associated with a respective lead, said leads being disposed one behind the other with respect to the front ends of said needles, the needle associated with the lead at the rear having a thinned part at the place where it crosses the lead disposed at the front.

* * * * *